US005318887A

United States Patent [19]

Takada et al.

[11] Patent Number: 5,318,887

[45] Date of Patent: Jun. 7, 1994

[54] METHOD FOR PRODUCTION OF SILVER HALIDE EMULSION, AND SILVER HALIDE PHOTOGRAPHIC LIGHT-SENSITIVE MATERIAL

[75] Inventors: Hiroshi Takada; Tadanobu Sekiya, both of Hino; Syoji Matsuzaka, Hachioji, all of Japan

[73] Assignee: Konica Corporation, Tokyo, Japan

[21] Appl. No.: 890,837

[22] Filed: Jun. 1, 1992

[30] Foreign Application Priority Data

Jun. 6, 1991 [JP] Japan ..... 3-134970

[51] Int. Cl.[5] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 1,574,944 | 3/1926 | Sheppard | 430/603 |
| 1,602,592 | 10/1926 | Sheppard | 430/603 |
| 1,623,499 | 4/1927 | Sheppard et al. | 430/603 |
| 2,222,264 | 11/1940 | Nietz et al. | 430/603 |
| 2,278,947 | 4/1942 | Riester | 430/570 |
| 2,410,689 | 11/1946 | Sheppard et al. | 430/603 |
| 2,448,534 | 9/1948 | Lowe et al. | 430/599 |
| 2,688,545 | 9/1954 | Carroll et al. | 131/70 |
| 2,728,668 | 12/1955 | Mochel | 430/603 |
| 2,912,329 | 11/1959 | Jones et al. | 430/550 |
| 3,271,157 | 9/1966 | McBride | 430/603 |
| 3,320,069 | 5/1967 | Illingsworth | 430/603 |
| 3,397,060 | 8/1968 | Schwan et al. | 430/550 |
| 3,501,313 | 3/1970 | Willems et al. | 430/603 |
| 3,574,628 | 4/1971 | Jones | 430/567 |
| 3,615,635 | 10/1971 | Shiba et al. | 430/576 |
| 3,628,964 | 12/1971 | Shiba et al. | 430/574 |
| 3,656,955 | 4/1972 | Ushimaru et al. | 430/600 |
| 3,704,130 | 11/1972 | Pollet et al. | 430/567 |
| 4,276,347 | 6/1981 | Shimada et al. | 428/332 |
| 4,297,439 | 10/1981 | Bergthaller et al. | 430/569 |

FOREIGN PATENT DOCUMENTS

| | | |
|---|---|---|
| 0326852 | 8/1989 | European Pat. Off. . |
| 0326853 | 8/1989 | European Pat. Off. . |
| 0370116 | 5/1990 | European Pat. Off. . |
| 0480294 | 4/1992 | European Pat. Off. . |
| 0484927 | 5/1992 | European Pat. Off. . |
| 3310609 | 10/1983 | Fed. Rep. of Germany . |

*Primary Examiner*—Janet C. Baxter

*Attorney, Agent, or Firm*—Finnegan, Henderson, Farabow, Garrett & Dunner

[57] ABSTRACT

A method of producing a silver halide emulsion and a silver halide photographic light-sensitive material containing the emulsion are disclosed. The silver halide emulsion comprises light-sensitive silver halide grains containing at least one of first silver halide phases and at least one of second silver halide phases. The method comprises the steps of (a) forming the first silver halide phases in the presence of substantially one kind of first fine silver halide grains, said first silver halide phases having a silver halide composition different from that of the first fine silver halide grains, and (b) forming the second silver halide phases by supplying second fine silver halide grains having a solubility product higher than that of the first fine silver halide grains.

5 Claims, No Drawings

METHOD FOR PRODUCTION OF SILVER HALIDE EMULSION, AND SILVER HALIDE PHOTOGRAPHIC LIGHT-SENSITIVE MATERIAL

FIELD OF THE INVENTION

The present invention relates to a method for production of a silver halide emulsion, and a silver halide photographic light-sensitive material with excellent sensitivity and graininess.

In recent years, there have been increasing needs for silver halide photographic light-sensitive materials with high sensitivity, low fogging and excellent graininess. Accordingly, requirements for control of silver halide grains used in light-sensitive materials have been more strict and complex.

Traditionally, so-called core-shell emulsions, wherein halide composition differs between the inner and outer layers of silver halide grains, have been widely used from the viewpoint of sensitivity, graininess, developability and other properties, as disclosed in Japanese Patent Publication Open to Public Inspection (hereinafter referred to as Japanese Patent O.P.I. Publication) Nos. 15432/1982, 138538/1985, 143331/1985, 9137/1983, 9573/1983 and 48755/1984.

However, these emulsions proved subject to limitation as to improvement in the performance thereof, particularly sensitivity, graininess and fogging, because they involve the following fundamental problems in the grain formation process. Specifically, in the conventional grain formation (growth) process, a region with high ion concentration occurs locally in the vicinities of the supply nozzle and impeller because essential silver ions and halogen ions are supplied to the grain-forming reactor in the form of an aqueous solution of silver salt and an aqueous solution of halide. This uneven distribution of ion concentration in the reactor can lead to extended distribution of halide composition among the individual grains and/or microscopic unevenness of halide composition of each phase in the grains and/or formation of reduced silver.

With the aim of overcoming the above problem, Japanese Patent O.P.I. Publication No. 167537/1990 discloses a method of grain growth wherein an aqueous solution of silver salt and halide are supplied, and fine silver halide grains are supplied. In this method, the fine silver halide grains added form a part of the source of silver ions and halogen ions. The ions released from the fine grains which are added to the reactor and dispersed in the reactor under stirring become uniform in the reactor because their number is very high. However, since this method involves supply of an aqueous solution of silver salt and halide for grain growth, it does not give full solution to the above problem.

W089/06830, Japanese Patent O.P.I. Publication No. 183645/1989 and other publications disclose a method of grain growth wherein fine silver halide grains alone are added and ripened. This method, wherein silver ions and halogen ions are supplied exclusively by the fine grains, is recognized as a production method not posing the problem described above because of its principle.

With respect to this method of grain growth, two ways to form and add fine grains are known as follows.

Method I: Fine silver halide grains are formed by reaction of an aqueous solution of silver salt and an aqueous solution of halide in a mixing vessel other than a grain growth reactor, and immediately added to the reactor in which grains are in the course of growing.

Method II: Fine silver halide grains are previously prepared independently from the grain growth process and then added to a grain growth ractor at the beggining of grain growth.

However, when the present inventors made experiments to confirm the validity of these methods, almost no positive effects were obtained (even a deleterious effect was obtained) in terms of the photographic performance, particularly graininess, of the silver halide photographic light-sensitive material incorporating the thus-obtained emulsion in comparison with the emulsion prepared by the conventional method wherein an aqueous solution of silver salt and an aqueous solution of halide are supplied, though some effects were obtained in the prevention of microscopic unevenness of halide composition in the silver halide grains and prevention of formation of reduced silver.

Although the reason therefor remains unknown, the inventors speculate as follows.

In both methods I and II, grain growth is based on Ostwald ripening. It is therefore necessary to shorten the Ostwald ripening time if it is desired to shorten grain growth time. For this purpose, it is the common practice to conduct Ostwald ripening at high temperatures of over 70° C. (70° to 75° C. in Examples given in W089/06830 and Japanese Patent O.P.I. Publication No. 183645/1989), but grain growth time cannot be shortened satisfactorily (i.e., the fine grain dissolution speed is low).

Accordingly, gelatin decomposition due to grain growth over long time at high temperature, decrease in protective colloid quality, and flocculation of silver halide grains are thought to occur sequentially, which appears to deteriorate the graininess of the light-sensitive material.

SUMMARY OF THE INVENTION

It is an object of the present invention to provide a method of producing a silver halide emulsion excellent in sensitivity, fogging and graininess in a sufficiently shortened grain growth time.

It is another object of the present invention to provide a silver halide light-sensitive material excellent in sensitivity, fogging and graininess.

The objects of the present invention described above have been accomplished by the following constitutions:

(1) A method of producing a silver halide emulsion comprising light-sensitive silver halide grains, wherein said silver halide grains contain at least one first silver halide phase formed in accordance with the following method a (hereinafter referred to as phase A) and at least one second silver halide phase formed in accordance with the following method b (hereinafter referred to as phase B).

Method a: A first silver halide phase having a silver halide composition different from that of a substantially one kind of first fine silver halide grains is formed in the presence of said silver halide grains.

Method b: A second silver halide phase is formed by supplying at least one kind of second fine silver halide grains having a solubility product higher than that of the fine silver halide grains used for method a.

(2) A method of producing a silver halide emulsion as described in (1) above, wherein said one kind of fine silver halide grains used for method a are substantially fine silver iodide grains and the second silver halide phase is formed exclusively by supplying fine silver halide grains by method b.

(3) A method of producing a silver halide emulsion as described in (2) above, wherein the silver iodide content of a silver halide phase having the highest silver iodide content among the silver halide phases belonging to phase A is higher than that of the silver halide phase belonging to phase B.

(4) A method of producing a silver halide emulsion as described in (3) above, wherein at least one phase A having a silver iodide content of not less than 15 mol % is present.

(5) A method of producing a silver halide emulsion as described in (4) above, wherein at least one phase B having a silver iodide content of not more than 10 mol % is present.

(6) A silver halide photographic light-sensitive material having at least one emulsion layer on the support, wherein at least one of said emulsion layers contains at least one kind of silver halide emulsion obtained by the production method described in any of (1) through (5) above.

(7) A silver halide emulsion comprising light-sensitive silver halide grains wherein said silver halide grains contain at least one first silver halide phase formed in accordance with the following description a and at least second one silver halide phase formed in accordance with the following description b.

(a) A first silver halide phase wherein a silver halide composition different from that of substantially one kind of first fine silver halide grains has been formed in the presence of said silver halide grains.

(b) A second silver halide phase formed by supplying at least one kind of second fine silver halide grains having a solubility product higher than that of the fine silver halide grains used in (a) above.

DETAILED DESCRIPTION OF THE INVENTION

The present invention is hereinafter described in detail.

In the present invention, silver halide grains with fine size are defined to have an average grain size of not more than 0.2 μm, and are hereinafter also referred to as fine silver halide grains for short.

In the above method a, "substantially one kind" means that there may be a difference of not more than 6 mol % in halide composition among the fine silver halide grains. Also, "to form a silver halide phase having a silver halide composition different from that of fine silver halide grains in the presence of said fine silver halide grains" means that said fine grains are used as a part of the source of silver and halide ions during formation of said phase.

Generally, the solubility product of silver halide grains depends on the grain size, halide composition and other factors thereof. For example, when the grain size is constant, solubility product increases in the order of silver iodide, silver bromide and silver chloride; when the grains comprise a solid solution of two or more kinds of silver halide, their solubility product increases as the content of silver halide with high solubility product increases. In the above method b, the purpose is accomplished by using at least one kind of fine silver halide grains whose solubility product is higher than that of the fine silver halide grains used for method a, whether the solubility product difference is based on grain size or composition.

With respect to method b, "to form a silver halide phase by supplying fine silver halide grains" means that not less than 90 mol % of silver ion and not less than 90 mol % of halide ions are supplied from said fine grains during formation of said phase.

With respect to (2) above, "substantially fine silver iodide grains" means that the silver iodide content of said fine grains is not less than 90 mol % of the total silver halide content. In this case, the silver iodide content is preferably not less than 95 mol %, more preferably 98 to 100 mol %.

With respect to (2) above, "to form a silver halide phase substantially exclusively by supplying fine silver halide grains" means that silver ion and halide ions are supplied from fine silver halide grains during formation of said phase without supplying silver ion and halide ions in the form of an aqueous silver salt solution and on aqueous halide solution except for the purpose of adjusting pAg (logarithm of the reciprocal of silver ion concentration) during formation of said phase.

In forming a phase having the desired halide composition in silver halide grains in the mixing vessel by adding fine silver halide grains, conventional methods, i.e., methods I and II, achieve grain growth by forming fine grains having the same composition as the desired halide composition in the fine grain formation process and adding said fine grains, while the inventive method a is characterized by supplying a part of the desired silver halide composition in the form of fine silver halide grains.

This means that when a phase A having a composition of $AgCl_5AgBr_{80}AgI_{15}$ (%) is formed using fine silver iodide grains, for instance, an aqueous solution of 85 mol % silver salt, an aqueous solution of halide containing 5 mol % chloride and 80 mol % bromide, and 15 mol % fine silver iodide grains are simultaneously added to grow grains. In the phase A thus formed, iodine ions are supplied from the fine silver iodide grains; the fine grains dispersed in the solution in the reactor by stirring in the same manner as in methods I and II rapidly release ions due to the very small size of the individual grains and offers uniform iodine ion concentration in the reactor due to the very great number thereof, which in turn eliminates uneven silver iodide distribution, whether within or among the grains. Moreover, the use of the method of the present invention allows remarkable improvement in grain growing speed in comparison with the conventional methods I and II. The grain growing speed improving effect increases with the content of silver halide composition with low solubility product (e.g., with the silver iodide content in the case of silver iodobromide).

The marked improvement in the speed of growth of silver halide phase with low solubility product obtained by the method of the present invention is thought of as associated with a difference in the mechanism of fine grain dissolution.

Specifically, it can be speculated that the growth obtained by the conventional methods depends solely on so-called Ostwald ripening mechanism based on solubility difference resulting from a difference between the grain size of seed grains (grains to be grown) and that of fine grains, while the growth obtained by the method of the present invention is driven not only by Ostwald ripening but also by increase in entropy due to uniformization of composition difference.

This mechanism is described below for silver iodobromide, for instance.

The present inventors experimentally examined the effects of the grain size (0.03 μm or 0.2 μm) of the fine silver iodide grains added on the rate of consumption of fine silver iodide grains in a system wherein fine silver iodide grains are added to seed grains of silver iodobromide (grain size 0.093 μm) and silver ions and bromine ions are supplied by the double jet method; the rate of the consumption was not affected by grain size difference among the silver iodide grains.

This demonstrates that the silver iodide grain consumption mechanism is not based on grain size difference from seed grains (Gibbs-Thomson effect). Then, Gibbs's free energy change ΔG in view of entropy change upon formation of silver iodide solid solution can be expressed by the following equation:

$$\Delta G = \Delta H - T\Delta S$$

If we assume that 0.6 mol of silver bromide grains and 0.4 mol of silver iodide grains having the same size as the silver bromide grains are mixed to form 1 mol of silver iodobromide grains having a silver iodide content of 40 mol %, for instance, then the term for entropy change upon formation of solid solution can be expressed as follows:

$$\Delta S = -R[(1-f)ln(1-f)+flnf],\ f=0.4$$

If the temperature is 40° C., we obtain a figure of TΔS=419 (Cal/mol).

On the other hand, ΔG in Ostwald ripening for pure silver bromide can be obtained as follows.

The solubility of grains having a diameter of d (μm) can be expressed as follows:

$$Sd = exp(67.6/d \times 10000)S$$

$$\Delta G = RTln(sd_1/sd_2)$$

Thus, if we assume $d_1=0.05$ μm and $d_2=0.5$ μm, then we obtain a figure of 75.6 (Cal/mol) for ΔG, only about one-sixth of the entropy upon formation of silver iodobromide.

In short, in the above system, the fine silver iodide grain consumption mechanism is based mainly on increase in entropy upon conversion of silver iodide and silver bromide into silver iodobromide.

In the method of the present invention, the use of a silver halide solvent added to the reactor offers a higher dissolution speed for fine grains.

Examples of silver halide solvents include water-soluble bromides, water-soluble chlorides, thiocyanates, ammonia, thioether and thioureas, specifically the thiocyanates described in U.S. Pat. Nos. 2,222,264, 2,448,534 and 3,320,069, ammonia, the thioether compounds described in U.S. Pat. Nos. 3,271,157, 3,574,628, 3,704,130, 4,297,439 and 4,276,347, the thion compounds described in Japanese Patent O.P.I. Publication Nos. 144319/1978, 82408/1978 and 77737/1980, the amine compound described in Japanese Patent O.P.I. Publication No. 100717/1979, the thiourea derivative described in Japanese Patent O.P.I. Publication No. 2982/1980, the imidazoles described in Japanese Patent O.P.I. Publication No. 100717/1979, and the substituted mercaptotetrazole described in Japanese Patent O.P.I. Publication No. 202531/1982.

The fine silver halide grains used in the present invention, the methods of addition thereof and the methods of formation thereof are described below.

The grain size of the fine silver halide grains for the present invention is preferably not more than 0.2 μm, more preferably not more than 0.1 μm, still more preferably not more than 0.05 μm, and further more preferably not more than 0.03 μm.

The halide composition of the fine silver halide grains of the present invention is widely variable within the scope of the present invention according to the desired halide composition.

In the present invention, the fine silver halide grains are added preferably in the form of a fine silver halide grain emulsion suspended in dispersant.

Two methods are available to add fine silver halide grains (emulsion). In method a, it is preferable to add the fine grains simultaneously with an aqueous solution of silver salt and an aqueous solution of another halide in a molar ratio necessary to form the desired silver halide composition, but this is not limitative. For example, when using a fine silver iodide grain emulsion to form a phase having a very high silver iodide content (e.g., 20 mol % to the solid solution limit), it is sometimes preferable to add the fine silver iodide grain emulsion in a ratio higher than the theoretically necessary molar ratio, which ratio can be optionally selected as necessary.

In method b, a single kind of fine silver halide grains having the same halide composition as of the desired phase may be used. Also, two or more kinds of fine silver halide grains with different halide compositions may be used; the method described in Japanese Patent Application No. 236858/1990, which was developed by the present inventors, can also be used preferably.

The rate of addition of fine silver halide grains (emulsion) is preferably controlled as a function of time.

Addition of fine grain emulsion, silver salt and aqueous solution of halide is preferably in accordance with the double jet method, the triple jet method or the multiple jet method.

In any of the above cases, any of methods I and II may be used to form and add fine silver halide grains (emulsion).

The fine silver halide grain for the present invention can be formed in an aqueous solution possessing a protective colloid property. In this case, grain formation temperature is preferably low for grain size reduction. Therefore, the formation temperature is preferably under 60° C., more preferably under 50° C., still more preferably under 40° C., and further still more preferably under 30° C.

All the fine grains described above are subject to no limitation with respect to the gelatin used to form them. For example, gelatin with a molecular weight of about 100000 for ordinary photographic use can be used preferably. When grain formation temperature is lowered to reduce the grain size of the fine grains to be formed, it is preferable to use a low molecular gelatin with a molecular weight of not more than 70000, more preferably not more than 50000, and still more preferably not more than 30000.

The gelatin concentration during fine grain formation is preferably not less than 1% by weight, more preferably not less than 3% by weight. When using a low molecular gelatin, the gelatin concentration is preferably higher, specifically not less than 5% by weight.

The rate of rotation of the impeller during fine grain formation is preferably not less than 1000 rpm for a closed mixing vessel, or not less than 700 rpm for an open mixing vessel.

The fine grain emulsion may be desalinized to remove the undesirable salts between grain formation and addition to the reactor. In this case, it is preferable to use the method or ultrafiltration membrane described in Japanese Patent O.P.I. Publication No. 293436/1988 or 185549/1989 or Japanese Patent Application No. 33493/1990.

The temperature of the solution in the reactor during grain growth is preferably over 50° C., more preferably over 60° C., and still more preferably over 70° C.

The silver halide photographic light-sensitive material of the present invention, which incorporates a silver halide emulsion obtained by the production method of the present invention (hereinafter also referred to as the silver halide emulsion of the present invention), is described below.

With respect to the silver halide emulsion of the present invention, the silver halide grains (hereinafter also referred to as the silver halide grains of the present invention) has at least one phase A formed in accordance with the above method a and at least one phase B formed in accordance with the above method b; for enhancing the effect of the present invention to obtain more improvement in grain growing speed and effective fogging reduction, it is preferable to form the phase with lower solubility product by method a, the phase with higher solubility product by method b, the inner phase by method a and the outer phase by method b.

Specifically, when the silver halide grains mainly comprise silver iodobromide, it is preferable to locate phase A with higher silver iodide content in the inner phase and phase B with lower silver iodide content in the outer phase.

With respect to the silver halide emulsion used in the light-sensitive material of the present invention, the silver halide composition may be any of silver iodochloride, silver iodobromide, silver chlorobromide and silver iodochlorobromide, but silver iodobromide is preferable, since it yields an emulsion with high sensitivity. A small amount of silver chloride may be added to improve sensitivity and rapid processing quality.

The silver iodide content of each of the silver halide phases belonging to phase A is preferably not less than 3 mol %, more preferably 5 mol % to the solid solution limit, and still more preferably 10 mol % to the solid solution limit. Also, the silver iodide content of at least one silver halide phase belonging to phase A is preferably not less than 15 mol %, more preferably 20 mol % to the solid solution limit, and still more preferably 25 mol % to the solid solution limit.

The silver iodide content of each of the silver halide phases belonging to phase B is preferably not more than 10 mol %, more preferably 0 mol % to 5 mol %, and still more preferably 0 mol % to 3 mol %.

When preparing silver iodobromide grains comprising three or more silver halide phases with different silver iodide contents, e.g., 30 mol %, 10 mol % and 3 mol % from inside, it is preferable to form the 30 mol % phase by method a and the 3 mol % phase by method b. In this embodiment, the 10 mol % phase (referred to as the intermediate phase), which has the intermediate silver iodide content, may be formed by any of methods a and b, but when the intermediate phase has a silver iodide content of not less than 10 mol %, it is more preferable to form it by method a.

The average silver iodide content of the silver halide grains of the present invention is preferably 2 to 20 mol %, more preferably 3 to 15 mol %, and still more preferably 5 to 12 mol %.

With respect to the silver halide grains of the present invention, phases A and B each preferably account for 2 to 90% of the total silver content in each grain, more preferably 5 to 80%, and still more preferably 10 to 70%. Also, for enhancing the effect of the present invention, it is preferable that phase A or a silver halide phase not belonging to phase B account for not more than 60%, more preferably 0 to 40%, and still more preferably 0 to 20% of the total silver content in each grain.

The silver halide grains of the present invention preferably have a surface phase with high silver iodide content formed by method a or b to improve the adsorptivity and storage stability of sensitizing dyes. In this case, the average thickness of said phase is preferably not more than 100 Å, more preferably not more than 50 Å.

When silver halide grains are grown from seed grains in the production method of the present invention, the grains may have in the central portion thereof a region whose halide composition is different from that of phase A or phase B. In this case, the halide composition of the seed grains is preferably silver iodobromide, though it may be any one of silver chloride, silver bromide, silver chlorobromide, silver iodochloride, silver iodobromide and silver iodobromochloride. It is also preferable that the seed grains account for not more than 50%, more preferably not more than 20% of the total silver content in each grain.

To determine the compositional structure of the silver halide grains of the present invention, the following means, for example, can be used. In accordance with the method of Inoue et al. described in the proceedings of a meeting of the Society of Photographic Science and Technology of Japan, pp. 46–48, silver halide grains are dispersed and solidified in methacryl resin, after which they are prepared as ultrathin sections using a microtome. The sections having a cross sectional area of over 90% of the maximum cross sectional area are selected. The silver iodide content and distribution are determined by the XMA method on the straight line drawn from the center to outer periphery of the least circumcircle with respect to the cross section, whereby the silver iodide content structure of the grains can be obtained.

The XMA method (X-ray microanalysis) is described below. Silver halide grains are dispersed in an electron microscopic grid device set on an electron microscope, and magnifying power is set with liquid nitrogen cooling so that a single grain appears in the CRT field. The intensities of AgL$\alpha$ and IL$\alpha$ rays are each integrated for a given period using an energy dispersion type X-ray analyzer. From the IL$\alpha$/AgL$\alpha$ intensity ratio and the previously drawn working curve, the silver iodide content can be calculated.

X-ray diffraction can be used to examine the structure of silver halide grains. The X-ray diffraction method is briefly described below.

As the X-ray irradiation source, various characteristic X-rays can be used, of which the CuK$\alpha$ ray, wherein Cu is the target, is most commonly used.

Since silver iodobromide has a rock salt structure and since its (420) diffraction line with CuKα ray is observed with relatively intense signal at a high angle of $2\theta = 71$ to 74°, the CuKα ray is most suitable as a tool of crystalline structural determination with high resolution.

In measuring the X-ray diffraction of photographic emulsion, it is necessary to remove gelatin, mix a reference sample such as silicon and use the powder method.

The determination can be achieved with reference to "Kiso Bunseki Kagaku Koza", vol. 24, "X-ray Analysis", published by Kyoritsu Shuppan.

The emulsion of the present invention preferably has a more uniform silver iodide content distribution among the grains. The relative standard deviation of the measurements of average silver iodide content is preferably not more than 20%, more preferably not more than 15%, and still more preferably not more than 12%, as measured by the XMA method for each silver halide grain.

Here, relative standard deviation is obtained by dividing the standard deviation of silver iodide content for at least 100 emulsion grains by the average silver iodide content and multiplying it by a factor of 100.

The silver halide grains of the present invention may be supplemented with metal ions using at least one kind of metal salt selected from the group comprising cadmium salts, zinc salts, lead salts, thallium salts, iridium salts (including complex salts), rhodium salts (including complex salts) and iron salts (including complex salts) to contain such metal elements in and/or on the grains during grain formation and/or grain growth. Also, reduction sensitization specks can be provided in and/or on the grains by bringing the grains in an appropriate reducing atmosphere.

The silver halide grains of the present invention are not subject to limitation with respect to crystal habit.

The silver halide grains of the present invention may be of a normal crystal such as cubic, octahedral, dodecahedral, tetradecahedral or tetraicosahedral crystal, or a twin crystal of tabular or another form, or of amorphous grains such as those in a potato-like form. The silver halide grains may comprise a mixture of these forms.

In the case of a tabular twin crystal, it is preferable that grains wherein the ratio of the diameter of circle converted from projected area and the grain thickness is 1 to 20 account for not less than 60% of the projected area, more preferably 1.2 to 8.0, and still more preferably 1.5 to 5.0.

The silver halide emulsion of the present invention is preferably a monodispersed silver halide emulsion.

A highly monodispersed emulsion preferred for the present invention has a distribution width of not more than 20%, more preferably not more than 15%, defined as follows.

$$(\textit{Grain size standard deviation/average grain size}) \times 100 = \textit{distribution width}\ (\%)$$

The grain diameter stated here is the diameter of a circle converted from a grain projection image with the same area.

Grain size can be obtained by measuring the diameter of the grain or the area of projected circle on an electron micrograph taken at ×10000 to 50000 (the number of subject grains should be not less than 1000 randomly).

Here, grain size is measured by the method described above, and average grain size is expressed in arithmetic mean.

$$\textit{Average grain size} = \Sigma d_i n_i / \Sigma n_i$$

The average grain size of the silver halide emulsion of the present invention is preferably 0.1 to 10.0 μm, more preferably 0.2 to 5.0 μm, and still more preferably 0.3 to 3.0 μm.

With respect to the emulsion of the present invention or another emulsion used in combination therewith as necessary to form a light-sensitive material obtained using the emulsion of the invention (hereinafter also referred to as the light-sensitive material of the present invention), a non-gelatin substance which is adsorptive to silver halide grains may be added during preparation thereof (including preparation of the seed emulsion). Examples of substances which serve well as such adsorbents include compounds used as sensitizing dyes, antifogging agents or stabilizers by those skilled in the art, and heavy metal ions.

Examples of the adsorbent described above are given in Japanese Patent O.P.I. Publication No. 7040/1987, for instance.

Of the adsorbents, at least one antifogging agent or stabilizer is preferably added during preparation of the seed emulsion, since it reduces emulsion fogging and improves the storage stability of the emulsion.

Of the antifogging agents and stabilizers, heterocyclic mercapto compounds and/or azaindene compounds are preferred. Examples of more preferable compounds are described in detail in Japanese Patent O.P.I. Publication No. 41848/1988, for instance.

Although the amount of the heterocyclic mercapto compounds and azaindene compounds added is not limitative, it is preferably $1\times10^{-5}$ to $3\times10^{-2}$ mol, more preferably $5\times10^{-5}$ to $3\times10^{-3}$ mol per mol of silver halide.

The finished emulsion, provided with a given set of grain conditions, may be desalinized by a known method after formation of silver halide grains. Desalinization may be achieved using the method described in Japanese Patent O.P.I. Publication No. 243936/1988, 185549/1989 and 236046/1991 or Japanese Patent Application No. 41314/1991 or using the noodle washing method wherein gelatin is gelled. Also available is the coagulation method utilizing an inorganic salt comprising a polyvalent anion, such as sodium sulfide, an anionic surfactant or an anionic polymer such as polystyrene sulfonic acid.

Usually, the silver halide emulsion thus desalinized is re-dispersed in gelatin to yield an emulsion.

The light-sensitive material of the present invention may incorporate silver halide grains other than the silver halide grains of the invention.

The silver halide grains used in combination with the silver halide grains of the invention may have any grain size distribution, i.e., the emulsion may be an emulsion having a broad grain size distribution (referred to as polydispersed emulsion) or a monodispersed emulsion with a narrow grain size distribution.

The light-sensitive material of the present invention is formed by adding the silver halide grains of the invention to at least one of the silver halide emulsion layers which constitute it, but the same layer may contain silver halide grains other than the silver halide grains of the invention.

In this case, it is preferable that the emulsion containing the silver halide grains of the present invention account for not less than 20% by weight, more preferably not less than 40% by weight. When the light-sensitive material of the present invention has two or more silver halide emulsion layers, there may be an emulsion layer comprising silver halide grains other than the silver halide grains o the invention.

In this case, it is preferable that the emulsion of the present invention account for not less than 10% by weight, more preferably not less than 20% by weight of the silver halide emulsions used in all the light-sensitive layers constituting the light-sensitive material.

The silver halide grains of the present invention may be spectrally sensitized using the spectral sensitizers described in the following volumes and pages of Research Disclosure (hereinafter referred to as RD) singly or in combination with another sensitizer.

RD No. 17643, pp. 23–24

RD No. 18716, pp. 648–649

RD No. 308119. p. 996, IV, Terms A, B, C., D, H, I, J

The effect of the present invention is enhanced by spectrally sensitizing the silver halide grains of the invention. It is particularly preferable to use a trimethine and/or monomethine cyanine dye singly or in combination with another spectral sensitizer as a spectral sensitizer for the emulsion and color light-sensitive material of the present invention.

Also, the silver halide grains other than the silver halide grains of the present invention, used as necessary in the light-sensitive material of the invention, may be optically sensitized in the desired wavelength range. In this case, the method of optical sensitization is not subject to limitation; for example, cyanine dyes, merocyanine dyes and other optical sensitizers, such as zeromethine dyes, monomethine dyes, dimethine dyes and trimethine dye, may be used singly or in combination to optically sensitize the grains. Sensitizing dyes are often used in combination for the purpose of supersensitization. The emulsion may contain a supersensitizing dye which is a dye having no spectral sensitizing activity or which is a substance showing substantially no absorption of visible light along with sensitizing dyes. These methods are described in U.S. Pat. Nos. 2,688,545, 2,912,329, 3,397,060, 3,615,635 and 3,628,964, British Patent Nos. 1,195,302, 1,242,588 and 1,293,862, West German Patent OLS Nos. 2,030,326 and 2,121,780, Japanese Patent Examined Publication No. 14030/1968 and RD No. 17643 (issued December, 1978), p. 23, IV, Term J, and other publications.

In the present invention, various ordinary chemical sensitization treatments may be performed. Of the chalcogen sensitizers used for chemical sensitization, sulfur sensitizers and selenium sensitizers are preferred for photographic use. Known sulfur sensitizers can be used, including thiosulfates, allyl thiocarbamides, thioureas, allyl isothiocyanates, cystine, p-toluenethiosulfonate and rhodanines. The sulfur sensitizers described in U.S. Pat. Nos. 1,574,944, 2,410,689, 2,278,947, 2,728,668, 3,501,313 and 3,656,955, West German Patent OLS No. 1,422,869, Japanese Patent O.P.I. Publication Nos. 24937/1981 and 45016/1980 and other publications can also be used. The sulfur sensitizer is added in an amount sufficient to effectively increase the sensitivity of emulsion. Although this amount varies over a rather wide range according to various conditions such as pH, temperature and silver halide grain size, the amount is preferably about $10^{-7}$ to $10^{-1}$ mol per mol of silver halide.

Examples of usable selenium sensitizers include those described in U.S. Pat. Nos. 1,574,944, 1,602,592 and 1,623,499. Although the amount of addition varies over a wide range like sulfur sensitizers, it is preferably about $10^{-7}$ to $10^{-1}$ mol per mol of silver halide.

In the present invention, various gold compounds can be used as gold sensitizers, whether the valency of gold is +1 or +3. Typical examples thereof include chloroauric acids, potassium chloroaurate, auric trichloride, potassium auric thiocyanate, potassium iodoaurate, tetracyanoauric acid, ammonium aurothiocyanate and pyridyl trichloroaurate.

Although the amount of gold sensitizer added varies according to various conditions, it is preferably about $10^{-7}$ to $10^{-1}$ mol per mol of silver halide.

Timing of addition of gold sensitizer may be simultaneous with the addition of a sulfur sensitizer or selenium sensitizer or during or after completion of the sulfur or selenium sensitization process.

The pAg and pH of the emulsion to be subjected to sulfur sensitization or selenium sensitization and gold sensitization for the present invention preferably range from 5.0 to 0.0 and 5.0 to 9.0, respectively.

The chemical sensitization method for the present invention may be used in combination with other sensitization methods using salts of other noble metals such as platinum, palladium, iridium and rhodium or complex salts thereof.

Examples of compounds which effectively act to eliminate the gold ion from gold gelatinate and promote gold ion adsorption to silver halide grains include complexes of Rh, Pd, Ir, Pt and other metals.

Such complexes include $(NH_4)_2[PtCl_4)]$, $(NH_4)_2[PdCl_4]$, $K_3[IrBr_6]$ and $(NH_4)_3[RhCl_6]_{12}H_2O$, with preference given to ammonium tetrachloropalladate (II) $(NH_4)_2[PdCl_4]$. The amount of addition preferably ranges from 10 to 100 times the amount of gold sensitizer as of stoichiometric ratio (molar ratio).

Although the timing of addition may be at initiation, during or after completion of chemical sensitization, it is preferable to add these compounds during chemical sensitization, more preferably simultaneously with, or immediately before or after, addition of gold sensitizer.

In the chemical sensitization treatment, a compound having a nitrogen-containing heterocyclic ring, particularly an azaindene ring, may also be present.

Although the amount of nitrogen-containing heterocyclic compound added varies over a wide range according to the size and composition of emulsion grains, chemical sensitization conditions and other factors, it is added preferably in an amount such that one to ten molecular layers are formed on the surface of silver halide grains. This amount of addition can be adjusted by controlling the adsorption equilibrium status by changing the pH and/or temperature during sensitization. Also, two or more of the compounds described above may be added to the emulsion so that the total amount thereof falls in the above range. The compound may be added to the emulsion in solution in an appropriate solvent which does not adversely affect the photographic emulsion. The timing of addition is preferably before or simultaneous with the addition of a sulfur sensitizer or selenium sensitizer for chemical sensitization. The timing of addition of gold sensitizer may be during or after completion of sulfur or selenium sensitization.

The silver halide grains may also be optically sensitized with a sensitizing dye in the desired wavelength range.

In performing the present invention, various additives may be added to the light-sensitive material. Examples of usable known photographic additives are given in the following RD numbers. The following table shows where the additives are described.

| Item | Page and Terms in RD308119 | Page in RD17643 | Page in RD18716 |
|---|---|---|---|
| Antistaining agent | 1002, VII-Term I | 25 | 650 |
| Dye image stabilizer | 1002, VII-Term J | 25 | |
| Brightening agent | 998, V | 24 | |
| Ultraviolet absorbent | 1003, VIII-Term C, XIII-Term C | 25–26 | |
| Light absorbent | 1003, VIII | 25–26 | |
| Light scattering agent | 1003, VIII | | |
| Filter dye | 1003, VIII | 25–26 | |
| Binder | 1003, IX | 26 | 651 |
| Antistatic agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Activator, coating aid | 1005, XI | 26–27 | 650 |
| Matting agent | 1007, XVI | | |
| Developing agent (contained in the light-sensitive material) | 1011, XX-Term B | | |

Various couplers may be used for the present invention. Examples thereof are given in the above RD numbers. The following table shows where they are described.

| Item | Page in RD308119 | RD17643 |
|---|---|---|
| Yellow couplers | 1001, VII-Term D | VII-Terms C–G |
| Magenta couplers | 1001, VII-Term D | VII-Terms C–G |
| Cyan couplers | 1001, VII-Term D | VII-Terms C–G |
| Colored couplers | 1002, VII-Term G | VII-Term G |
| DIR couplers | 1001, VII-Term F | VII-Term F |
| BAR couplers | 1002, VII-Term F | |
| Other useful residues | 1001, VII-Term F | |
| Alkali-soluble couplers | 1001, VII-Term E | |

The additives used for the present invention can be added by dispersion as described in RD308119 XIV and by other methods.

In the present invention, the supports described in RD17643, p. 28, RD18716, pp. 647–648 and RD308119 XVII can be used.

The light-sensitive material of the present invention may be provided with auxiliary layers such as a filter layer and interlayer as described in RD308119, VII-Term K.

The light-sensitive material of the present invention can take various layer configurations such as the ordinary, reverse and unit structures described in RD308119, VII-Term K.

The present invention is preferably applicable to various color light-sensitive materials represented by color negative films for ordinary or movie use, color reversal films for slides or television, color printing paper, color positive films and color reversal printing paper. The invention can also be used for other various purposes such as ordinary black-and-white photography, X-ray photography, infrared photography, microwave photography, silver dye bleaching, diffusion transfer and reversion.

The light-sensitive material of the present invention can be developed by a known ordinary method. Examples of such methods include those described in RD17643, pp. 28–29, RD18716, p. 615 and RD308119 XIX.

EXAMPLES

The present invention is hereinafter described in more detail by means of the following examples, but the invention is not limited to these examples.

EXAMPLE 1

Preparation of Hexagonally Tabular Silver Iodobromide Emulsion EM-10 (Comparative Emulsion)

A hexagonally tabular silver iodobromide emulsion was prepared using spherical silver iodobromide grains having two parallel twin planes, an average grain size of 0.2 μm and a silver iodide content of 2 mol % as seed crystals.

While vigorously stirring the solution G-10 in the reactor at a temperature of 70° C., a pAg of 6.5 and a pH of 6.5, the seed emulsion in an amount equivalent to 0.07 mol was added.

Formation of Inner Phase with 20 Mol % Silver Iodide Content

H-10 and S-10, each in an amount equivalent to 3 mol, were added to a reactor by the double jet method at increasing flow rates over a period of 76 minutes, while keeping a molar ratio of 100:100.

Formation of Outer Phase with 3 Mol % Silver Iodide Content

Subsequently, pAg and pH were adjusted to 9.7 and 6.8, respectively. H-11 and S-10, each in an amount equivalent to 6.93 mol, were added to the reactor in the same manner as above over a period of 36 minutes.

During grain formation, pAg and pH were regulated by adding an aqueous solution of potassium bromide and an aqueous solution of acetic acid to the reactor. After grain formation, the mixture was washed by the conventional flocculation method. After addition of gelatin the mixture was redispersed and adjusted to a pH of 5.8 and a pAg of 8.06 at 40° C.

The resulting emulsion was a monodispersed emulsion comprising hexagonally tabular silver iodobromide grains having an average grain size of 1.65 μm as the diameter of the circle converted from the projected area, an average thickness of 0.3 μm, a distribution width of 13.8% and a silver iodide content of 8.1 mol %.

This emulsion is referred to as EM-10.

Preparation of Hexagonally Tabular Silver Iodobromide Emulsion EM-11 (Comparative Emulsion)

A hexagonally tabular silver iodobromide emulsion was prepared using spherical silver iodobromide grains having two parallel twin planes, an average grain size of 0.20 μm and a silver iodide content of 2 mol % as seed crystals.

While vigorously stirring the solution G-10 in the reactor at a temperature of 70° C., a pAg of 8.5 and a pH of 6.5, the seed emulsion in an amount equivalent to 0.07 mol was added.

Formation of Inner Phase with 20 Mol % Silver Iodide Content (Phase A)

H-12 and S-10, each in an amount equivalent to 2.4 mol, and MC-10, in an amount equivalent to 0.6 mol, were added to a reactor at increasing flow rates by the triple jet method over a period of 76 minutes, while keeping a molar ratio of 80:80:20.

Formation of Outer Phase with 3 Mol % Silver Iodide Content (Phase A)

Subsequently, pAg and pH were adjusted to 9.7 and 6.8, respectively, after which H-12 and S-10, each in an amount equivalent to 6.73 mol, and MC-10, in an amount equivalent to 0.2 mol, were added in the same manner as above over a period of 36 minutes while keeping a molar ratio of 97:97:3.

During grain formation, pAg and pH were regulated by adding an aqueous solution of potassium bromide and an aqueous solution of acetic acid to the reactor. After grain formation, the mixture was washed by the conventional flocculation method. After addition of gelatin the mixture was re-dispersed in gelatin and adjusted to a pH of 5.8 and a pAg of 8.06 at 40° C.

The resulting emulsion was a monodispersed emulsion comprising hexagonally tabular silver iodobromide grains having an average grain size of 1.65 μm as the diameter of the circle converted from the projected area, an average thickness of 0.3 μm, a distribution width of 12.4% and a silver iodide content of 8.1 mol %.

This emulsion is referred to as EM-11.

Preparation of Hexagonally Tabular Silver Iodobromide Emulsion EM-12 (Comparative Emulsion)

A hexagonally tabular silver iodobromide emulsion was prepared using spherical silver iodobromide grains having two parallel twin planes, an average grain size of 0.20 μm and a silver iodide content of 2 mol % as seed crystals.

While vigorously stirring the solution G-10 in a reactor at a temperature of 70° C., a pAg of 8.5 and a pH of 6.5, the seed emulsion in an amount equivalent to 0.07 mol was added.

Formation of Inner Phase with 20 Mol % Silver Iodide Content (Phase B)

After an aqueous solution of ammonium acetate in an amount equivalent to 3 mol was added, MC-12 in an amount equivalent to 3 mol was added to the reactor at increasing flow rates by the single jet method over a period of 76 minutes.

Formation of Outer Phase with 3 Mol % Silver Iodide Content (Phase B)

Subsequently, an aqueous solution of ammonium acetate in an amount equivalent to 6.93 mol was added and pAg and pH were adjusted to 9.7 and 6.8, respectively, after which MC-I3 in an amount equivalent to 6.93 mol was added in the same manner as above over a period of 36 minutes.

During grain formation, pAg and pH were regulated by adding an aqueous solution of silver nitrate, an aqueous solution of potassium bromide and an aqueous solution of sodium carbonate to the reactor.

Grain observation after completion of the addition revealed the presence of a large number of fine grains of silver halide remaining undissolved.

Preparation of Hexagonally Tabular Silver Iodobromide Emulsion EM-13 (Comparative Emulsion)

Emulsion EM-13 was prepared in the same manner as in emulsion EM-12 except that the addition time for the inner phase was 1.5 times (114 minutes) and the addition time for the outer phase was 1.2 times (43 minutes).

After grain formation, the mixture was washed by the conventional flocculation method and then re-dispersed in gelatin and adjusted to a pH of 5.8 and a pAg of 8.06 at 40° C.

The resulting emulsion was a monodispersed emulsion comprising hexagonally tabular silver iodobromide grains having an average grain size of 1.65 μm as the diameter of the circle converted from the projected area, an average thickness of 0.3 μm, a distribution width of 11.6% and a silver iodide content of 8.1 mol %.

This emulsion is referred to as EM-13.

Preparation of Hexagonally Tabular Silver Iodobromide Emulsion EM-14 (Inventive Emulsion)

EM-14 was prepared in the same manner as in emulsion EM-11 until formation of the inner phase and then in the same manner as in emulsion EM-13 for formation of the outer phase and thereafter.

During grain formation, pAg and pH were regulated by adding an aqueous solution of silver nitrate, an aqueous solution of potassium bromide, an aqueous solution of sodium carbonate and an aqueous solution of acetic acid to the reactor.

The resulting emulsion was a monodispersed emulsion comprising hexagonally tabular silver iodobromide grains having an average grain size of 1.65 μm as the diameter of the circle converted from the projected area, an average thickness of 0.3 μm, a distribution width of 11.9% and a silver iodide content of 8.1 mol %.

This emulsion is referred to as EM-14.

Preparation of Hexagonally Tabular Silver Iodobromide Emulsion EM-15 (Inventive Emulsion)

EM-15 was prepared in the same manner as in emulsion EM-13 until formation of the inner phase and then in the same manner as in emulsion EM-11 for formation of the outer phase and thereafter.

During grain formation, pAg and pH were regulated by adding an aqueous solution of silver nitrate, an aqueous solution of potassium bromide, an aqueous solution of sodium carbonate and an aqueous solution of acetic acid to the reactor.

The resulting emulsion was a monodispersed emulsion comprising hexagonally tabular silver iodobromide grains having an average grain size of 1.65 μm as the diameter of the circle converted from the projected area, an average thickness of 0.3 μm, a distribution width of 12.2% and a silver iodide content of 8.1 mol %.

This emulsion is referred to as EM-15.

| G-10 | |
|---|---|
| Ossein gelatin (average molecular weight = 100000) | 120.0 g |
| Compound I | 25.0 ml |

-continued

| G-10 | |
|---|---|
| 28% aqueous ammonia | 440.0 ml |
| 56% aqueous solution of acetic acid | 660.0 ml |

Water was added to make a total quantity of 4000.0 ml.

Compound I: 10% aqueous ethanol solution of sodium salt of polyisopropylene-polyethyleneoxy-disuccinate

H-10

An aqueous solution of potassium bromide containing 20 mol % potassium iodide

S-10

An aqueous solution of ammoniacal silver nitrate

H-11

An aqueous solution of potassium bromide containing 3 mol % potassium iodide.

H-12

An aqueous solution of potassium bromide.

MC-10

A fine grain emulsion comprising 3 wt % gelatin and silver iodide grains having an average grain size of 0.03 μm, obtained as follows.

To 5000 ml of a 9.6 wt % gelatin solution containing 0.05 mol of potassium bromide were added 2500 ml of an aqueous solution containing 10.6 mol of silver nitrate and 2500 ml of an aqueous solution containing 10.6 mol of potassium bromide at increasing flow rates (the final flow rate was 5 times the initial flow rate) over a period of 28 minutes. During fine grain formation, the temperature was kept at 30° C. After fine grain formation, the undesirable salts were removed by ultrafiltration.

Electron micrography at a magnification factor of 60000 revealed that the obtained fine silver bromide grains had an average grain size of 0.032 μm.

MC-12

A fine grain emulsion prepared in the same manner as in MC-10, which comprised 3 wt % gelatin and silver iodobromide grains having a silver iodide content of 20 mol % and an average grain size of 0.02 μm and a solubility higher than that of MC-10.

MC-13

A fine grain emulsion prepared in the same manner as with MC-10, which comprised 3 wt % gelatin and silver iodobromide grains having a silver iodide content of 3 mol % and an average grain size of 0.02 μm and a solubility higher than that of MC-10 and MC-12.

Preparation of Silver Halide Photographic Light-sensitive Material Samples

Emulsions EM-10 through EM-15, except for EM-12, which was found to contain a large number of added fine silver halide grains even after preparation thereof, were each subjected to gold/sulfur sensitization and spectral sensitization optimally. Using these emulsions, layers were sequentially formed on a triacetyl cellulose film support in the order from the support side to yield multiple layered color photographic light-sensitive material samples.

In all examples given below, the amount of addition in silver halide photographic light-sensitive material is expressed in gram per $m^2$, unless otherwise stated. The figures for silver halide and colloidal silver have been converted to the amounts of silver. Figures for the amount of sensitizing dyes are shown in mol per mol of silver in the same layer.

The configuration of multiple layered color photographic light-sensitive material sample No. 1 was as follows.

| Sample No. 1 (comparative) | |
|---|---|
| Layer 1: Anti-halation layer HC | |
| Black colloidal silver | 0.2 |
| UV absorbent UV-1 | 0.23 |
| High boiling solvent Oil-1 | 0.18 |
| Gelatin | 1.4 |
| Layer 2: First interlayer IL-1 | 1.3 |
| Gelatin | |
| Layer 3: Low speed red-sensitive emulsion layer RL | |
| Silver iodobromide emulsion EM-L | 1.0 |
| Sensitizing dye SD-1 | $1.8 \times 10^{-5}$ |
| Sensitizing dye SD-2 | $2.8 \times 10^{-4}$ |
| Sensitizing dye SD-3 | $3.0 \times 10^{-4}$ |
| Cyan coupler C-1 | 0.70 |
| Colored cyan coupler CC-1 | 0.066 |
| DIR compound D-1 | 0.03 |
| DIR compound D-3 | 0.01 |
| High boiling solvent Oil-1 | 0.64 |
| Gelatin | 1.2 |
| Layer 4: Medium speed red-sensitive emulsion layer RM | |
| Silver iodobromide emulsion EM-M | 0.8 |
| Sensitizing dye SD-1 | $2.1 \times 10^{-5}$ |
| Sensitizing dye SD-2 | $1.9 \times 10^{-4}$ |
| Sensitizing dye SD-3 | $1.9 \times 10^{-4}$ |
| Cyan coupler C-1 | 0.28 |
| Colored cyan coupler CC-1 | 0.027 |
| DIR compound D-1 | 0.01 |
| High boiling solvent Oil-1 | 0.26 |
| Gelatin | 0.6 |
| Layer 5: High speed red-sensitive emulsion layer RH | |
| Silver iodobromide emulsion EM-10 | 1.70 |
| Sensitizing dye SD-1 | $1.9 \times 10^{-5}$ |
| Sensitizing dye SD-2 | $1.7 \times 10^{-4}$ |
| Sensitizing dye SD-3 | $1.7 \times 10^{-4}$ |
| Cyan coupler C-1 | 0.05 |
| Cyan coupler C-2 | 0.10 |
| Colored cyan coupler CC-1 | 0.02 |
| DIR compound D-1 | 0.025 |
| High boiling solvent Oil-1 | 0.17 |
| Gelatin | 1.2 |
| Layer 6: Second interlayer IL-2 | 0.8 |
| Gelatin | |
| Layer 7: Low speed green-sensitive emulsion layer GL | |
| Silver iodobromide emulsion EM-L | 1.1 |
| Sensitizing dye SD-4 | $6.8 \times 10^{-5}$ |
| Sensitizing dye SD-5 | $6.2 \times 10^{-4}$ |
| Magenta coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High boiling solvent Oil-2 | 0.81 |
| Gelatin | 1.8 |
| Layer 8: Medium speed green-sensitive emulsion layer GM | |
| Silver iodobromide emulsion EM-M | 0.7 |
| Sensitizing dye SD-6 | $1.9 \times 10^{-4}$ |
| Sensitizing dye SD-7 | $1.2 \times 10^{-4}$ |
| Sensitizing dye SD-8 | $1.5 \times 10^{-5}$ |
| Magenta coupler M-1 | 0.07 |
| Magenta coupler M-2 | 0.03 |
| Colored magenta coupler CM-1 | 0.04 |
| DIR compound D-2 | 0.018 |
| High boiling solvent Oil-2 | 0.30 |
| Gelatin | 0.8 |
| Layer 9: High speed | |

-continued

| Sample No. 1 (comparative) | |
|---|---|
| green-sensitive emulsion layer GH | |
| Silver iodobromide emulsion EM-10 | 1.7 |
| Sensitizing dye SD-4 | $2.1 \times 10^{-5}$ |
| Sensitizing dye SD-6 | $1.2 \times 10^{-4}$ |
| Sensitizing dye SD-7 | $1.0 \times 10^{-4}$ |
| Sensitizing dye SD-8 | $3.4 \times 10^{-6}$ |
| Magenta coupler M-1 | 0.09 |
| Magenta coupler M-3 | 0.04 |
| Colored magenta coupler CM-1 | 0.04 |
| High boiling solvent Oil-2 | 0.31 |
| Gelatin | 1.2 |
| Layer 10: Yellow filter layer YC | |
| Yellow colloidal silver | 0.05 |
| Antistaining agent SC-1 | 0.1 |
| High boiling solvent Oil-2 | 0.13 |
| Gelatin | 0.7 |
| Formalin scavenger HS-1 | 0.09 |
| Formalin scavenger HS-2 | 0.07 |
| Layer 11: Low speed blue-sensitive emulsion layer BL | |
| Silver iodobromide emulsion EM-L | 0.5 |
| Silver iodobromide emulsion EM-M | 0.5 |
| Sensitizing dye SD-9 | $5.2 \times 10^{-4}$ |
| Sensitizing dye SD-10 | $1.9 \times 10^{-5}$ |
| Yellow coupler Y-1 | 0.65 |
| Yellow coupler Y-2 | 0.24 |
| DIR compound D-1 | 0.03 |
| High boiling solvent Oil-2 | 0.18 |
| Gelatin | 1.3 |
| Formalin scavenger HS-1 | 0.08 |
| Layer 12: High speed blue-sensitive emulsion layer BH | |
| Silver iodobromide emulsion EM-10 | 1.0 |
| Sensitizing dye SD-9 | $1.8 \times 10^{-4}$ |
| Sensitizing dye SD-10 | $7.9 \times 10^{-5}$ |
| Yellow coupler Y-1 | 0.15 |
| Yellow coupler Y-2 | 0.05 |
| High boiling solvent Oil-2 | 0.074 |
| Gelatin | 1.3 |
| Formalin scavenger HS-1 | 0.05 |
| Formalin scavenger HS-2 | 0.12 |

-continued

| Sample No. 1 (comparative) | |
|---|---|
| Layer 13: First protective layer Pro-1 | |
| Fine silver iodobromide grain emulsion having an average grain size of 0.08 μm and an AgI content of 1 mol % | 0.4 |
| UV absorbent UV-1 | 0.07 |
| UV absorbent UV-2 | 0.10 |
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: Second protective layer Pro-2 | |
| Alkali-soluble matting agent having an average grain size of 2 μm | 0.13 |
| Polymethyl methacrylate having an average grain size of 3 μm | 0.02 |
| Lubricant WAX-1 | 0.04 |
| Gelatin | 0.6 |

In addition to these compositions, a coating aid Su-1, a dispersing agent Su-2, a viscosity controlling agent, hardeners H-1 and H-2, a stabilizer ST-1 and antifogging agents AF-1, AF-2 having an average molecular weight of 10000 and AF-2 having an average molecular weight of 110000 were added to appropriate layers.

The emulsions EM-L and EM-M used to prepare the sample had the following properties.

Each emulsion was subjected to optimum gold/sulfur sensitization. The details are given in Table 1.

TABLE 1

| Emulsion | Average grain size (μm) | Average silver iodide content (mol %) | Crystal habit |
|---|---|---|---|
| EM-L | 0.47 | 8.0 | Octahedral to tetradecahedral |
| EM-M | 0.82 | 8.0 | Octahedral |

C-1

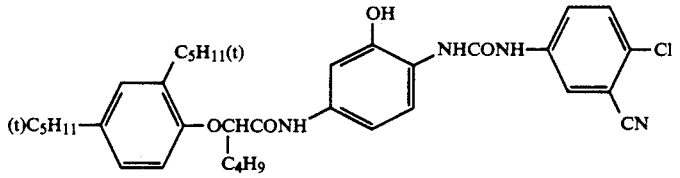

C-2

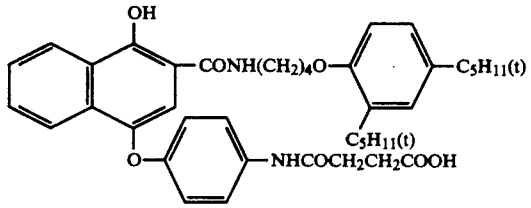

M-1

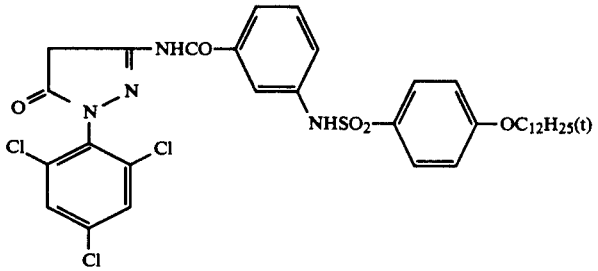

-continued
M-2
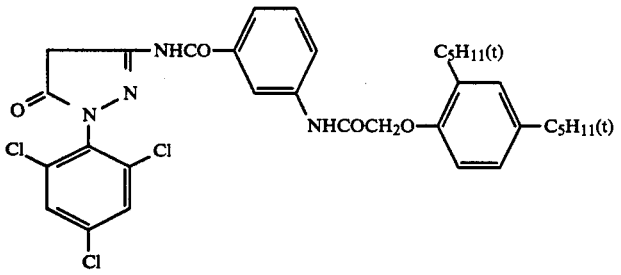
M-3
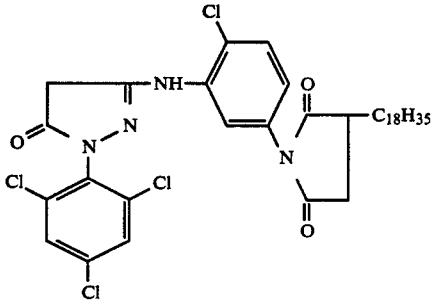
Y-1
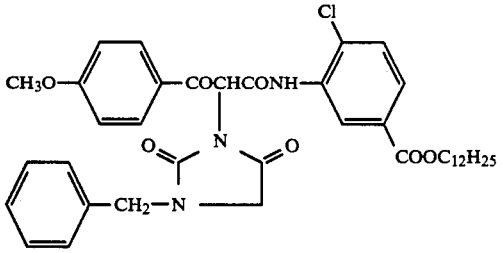
Y-2
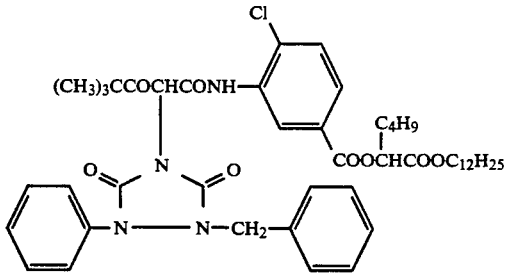
CC-1
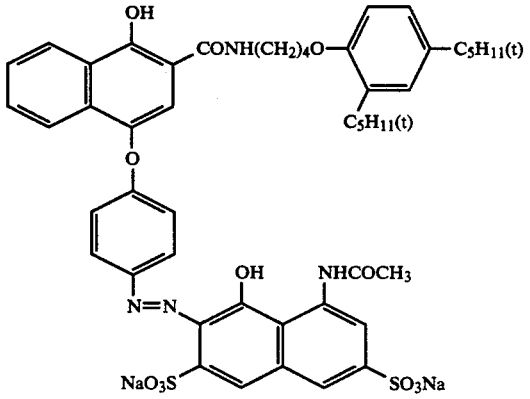

-continued
CM-1
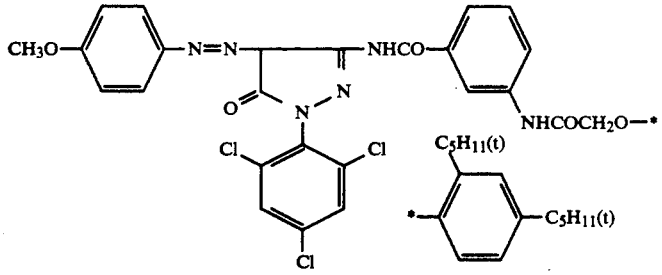
D-1
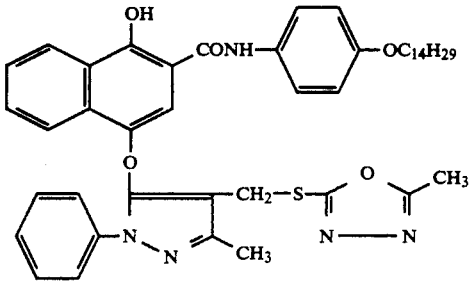
D-2
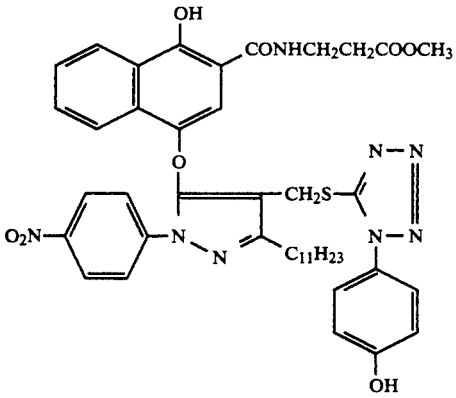
D-3
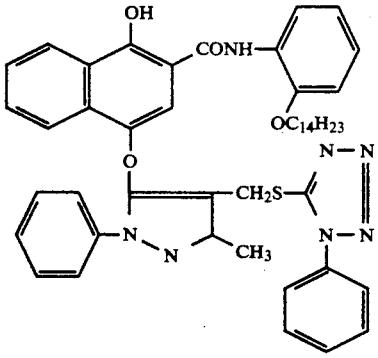
Oil-1
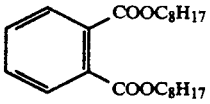
Oil-2
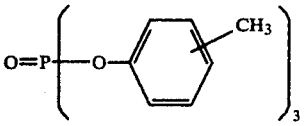

-continued
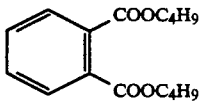
Oil-3
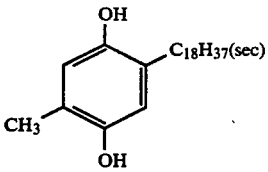
SC-1
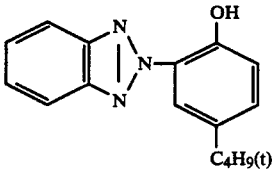
UV-1
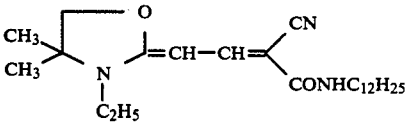
UV-2
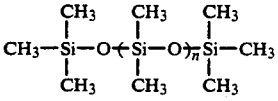
Weight-average molecular weight Mw = 3000
WAX-1
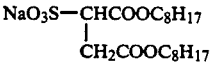
Su-1
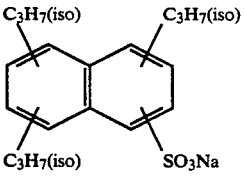
Su-2
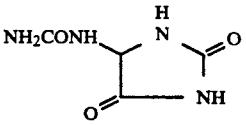
HS-1
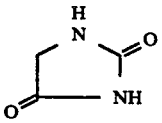
HS-2
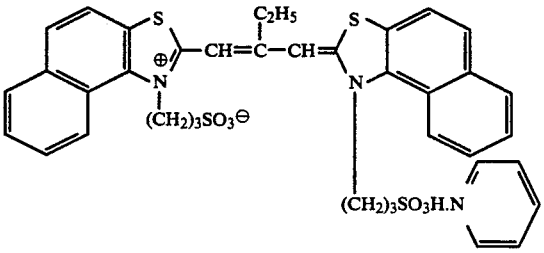
SD-1

-continued
SD-2
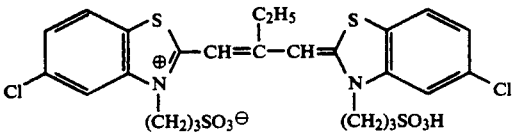
SD-3
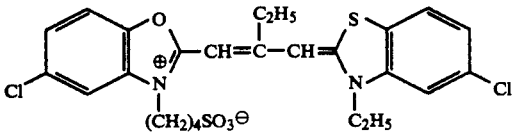
SD-4
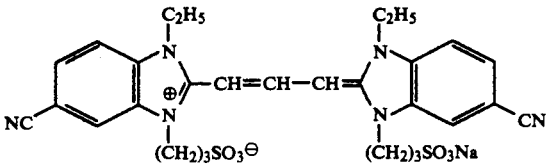
SD-5
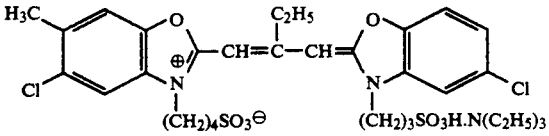
SD-6
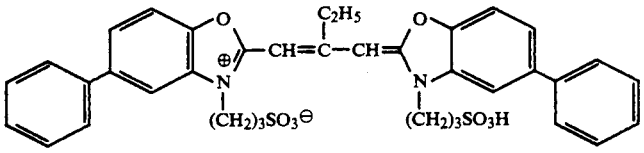
SD-7
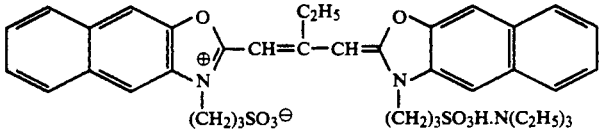
SD-8
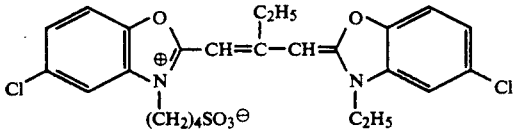
SD-9
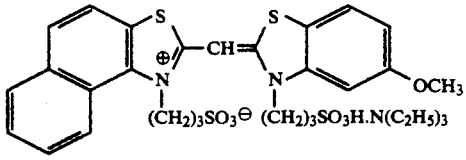
SD-10
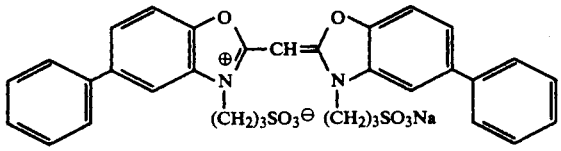
H-1
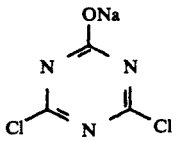
H-2
$(CH_2{=}CHSO_2CH_2)_2O$ -continued

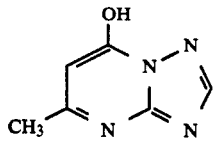

ST-1

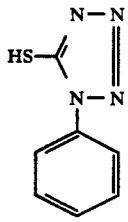

AF-1

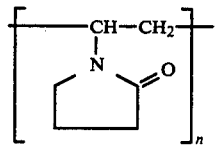

AF-2 n: Degree of polymerization

Next, sample Nos. 11 and 13 through 15 were prepared in the same manner as in sample No. 1 except that silver iodobromide emulsion EM-10 for layers 5, 9 and 12 was replaced with emulsions EM-11 and 13 through EM-15 as shown in Table 2.

The samples thus prepared were each subjected to white light exposure through an optical wedge and then developed as follows.

| | | |
|---|---|---|
| 1. Color development | 3 minutes 15 seconds | 38.0 ± 0.1° C. |
| 2. Bleaching | 6 minutes 30 seconds | 38.0 ± 3.0° C. |
| 3. Washing | 3 minutes 15 seconds | 24 to 41° C. |
| 4. Fixing | 6 minutes 30 seconds | 38.0 ± 3.0° C. |
| 5. Washing | 3 minutes 15 seconds | 24 to 41° C. |
| 6. Stabilization | 3 minutes 15 seconds | 38.0 ± 3.0° C. |
| 7. Drying | Under 50° C. | |

The processing solutions used in the respective processes had the following compositions.

| Color developer | |
|---|---|
| 4-amino-3-methyl-N-ethyl-N-(β-hydroxylethyl)-aniline sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |

Water was added to make a total quantity of 1000 ml (pH-equal 10.1).

| Bleaching solution | |
|---|---|
| Iron (III) ammonium ethylenediamine-tetraacetate | 100.0 g |
| Diammonium ethylenediaminetetraacetate | 10.0 g |
| Ammonium bromide | 150.0 g |
| Glacial acetic acid | 10.0 g |

Water was added to make a total quantity of 1000 ml, and aqueous ammonia was added to obtain a pH of 6.0.

| Fixing solution | |
|---|---|
| Ammonium sulfate | 175.0 g |
| Anhydrous sodium sulfite | 8.5 g |
| Sodium metasulfite | 2.3 g |

Water was added to make a total quantity of 1000 ml, and acetic acid was added to obtain a pH of 6.0.

| Stabilizer | |
|---|---|
| Formalin (37% aqueous solution) | 1.5 ml |
| Konidax (produced by Konica Corporation) | 7.5 ml |

Water was added to make a total quantity of 1000 ml.

The obtained samples were each subjected to determination of relative fogging, relative sensitivity and relative RMS value, using red light (R), green light (G) and blue light (B) immediately after preparation.

The results for green light (G) are shown in Table 2.

TABLE 2

| | Emulsion used in layers 5, 9 and 12 | | | | | | |
|---|---|---|---|---|---|---|---|
| Sample No. | Name | Method of inner phase formation | Method of outer phase formation | Time requirement | Relative RMS granularity | Relative sensitivity | Relative fogging |
| Sample No. 10 (comparative) | EM-10 (comparative) | — | — | 112 minutes | 100 | 100 | 100 |
| Sample No. 11 (comparative) | EM-11 (comparative) | Method a | Method a | 112 minutes | 85 | 125 | 85 |
| Sample No. 13 (comparative) | EM-13 (comparative) | Method b | Method b | 157 minutes | 105 | 140 | 75 |

TABLE 2-continued

| Sample No. | Name | Method of inner phase formation | Method of outer phase formation | Time requirement | Relative RMS granularity | Relative sensitivity | Relative fogging |
|---|---|---|---|---|---|---|---|
| | Emulsion used in layers 5, 9 and 12 | | | | | | |
| Sample No. 14 (Inventive). | EM-14 (Inventive) | Method a | Method b | 119 minutes | 70 | 175 | 65 |
| Sample No. 15 (Inventive) | EM-15 (Inventive) | Method b | Method a | 150 minutes | 90 | 150 | 75 |

Relative fogging, or the relative value for minimum density ($D_{min}$), is expressed in percent ratio relative to the $D_{min}$ of sample No. 10.

Relative sensitivity, the relative value for the reciprocal of the exposure amount which gives a density equivalent to $D_{min}+0.15$, is expressed in percent ratio relative to the sensitivity of sample No. 10.

Relative RMS value was determined at the point of a density equivalent to $D_{min}+0.15$ as with relative sensitivity.

RMS value was determined by scanning the subject portion of each sample using a microdensitometer with an open scanning area of 1800 $\mu m^2$ (slit width 10 $\mu m$, slit length 180 $\mu m$) equipped with a Ratten filter (W-26, W-99 and W-47 used for R, C and B, respectively) produced by Eastman Kodak; the data thus obtained was analyzed to obtain standard deviation for density changes among more than 1000 runs of density determination, and the results were expressed in percent ratio relative to the RMS value of sample No. 1. Graininess is improved as relative RMS value decreases.

Results similar to those shown in Table 2 were obtained from measurements using red light (R) and blue light (B).

The above samples were subjected to the following running procedure; similar evaluation results were obtained. Running processing was performed until the amount of replenisher supplied became 3 times the capacity of the stabilizing tank.

| Procedure | Processing time | Processing temperature | Amount of replenisher |
|---|---|---|---|
| Color development | 3 minutes 18 seconds | 38° C. | 540 ml |
| Bleaching | 45 seconds | 38° C. | 155 ml |
| Fixation | 1 minute 45 seconds | 38° C. | 500 ml |
| Stabilization | 90 seconds | 38° C. | 775 ml |
| Drying | 1 minute | 40-70° C. | — |

Note: Figures for the amount of replenisher are per $m^2$ of light-sensitive material.

The stabilizing treatment was conducted using the 3-tank counter current method, wherein the replenisher was added to the final stabilizer tank and overflown into the former tank.

A part (250 ml/$m^2$) of the overflow from the stabilizing tank following the fixing tank was flown into the stabilizing tank.

The color developer used had the following composition:

| | |
|---|---|
| Potassium carbonate | 30 g |
| Sodium hydrogen carbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-amino-3-methyl-N-ethyl-N-(β-hydroxylethyl)-aniline sulfate | 4.6 g |
| Diethylenetriaminepentaacetic acid | 3.0 g |

-continued

| | |
|---|---|
| Potassium hydroxide | 1.3 g |

Water was added to make a total quantity of 1000 ml, and potassium hydroxide or 20% sulfuric acid was added to obtain a pH of 10.01.

The color developer replenisher used had the following composition:

| | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-amino-3-methyl-N-ethyl-N-(β-hydroxylethyl) aniline sulfate | 6.0 g |
| Diethylenetriaminepentaacetic acid | 3.0 g |
| Potassium hydroxide | 2.0 g |

Water was added to make a total quantity of 1000 ml, and potassium hydroxide or 20% sulfuric acid was added to obtain a pH of 10.12.

The bleaching solution used had the following composition:

| | |
|---|---|
| Ferric ammonium 1,3-diaminopropanetetraacetate | 0.35 mol |
| Disodium ethylenediaminetetraacetate | 2 g |
| Ammonium bromide | 150 g |
| Glacial acetic acid | 40 ml |
| Ammonium nitrate | 40 g |

Water was added to make a total quantity of 1000 ml, and aqueous ammonia or glacial acetic acid was added to obtain a pH of 4.5.

The bleaching solution replenished used had the following composition:

| | |
|---|---|
| Ferric ammonium 1,3-diaminopropanetetraacetate | 0.40 mol |
| Disodium ethylenediaminetetraacetate | 2 g |
| Ammonium bromide | 170 g |
| Ammonium nitrate | 50 g |
| Glacial acetic acid | 61 ml |

Water was added to make a total quantity of 1000 ml, and aqueous ammonia or glacial acetic acid was added to obtain a pH of 3.5 to ensure appropriate pH level of the bleaching tank solution.

The fixing solution and fixing solution replenished used had the following composition:

| | |
|---|---|
| Ammonium thiosulfate | 100 g |
| Ammonium thiocyanate | 150 g |
| Anhydrous sodium bisulfite | 20 g |
| Sodium metabisulfite | 4.0 g |
| Disodium ethylenediaminetetraacetate | 1.0 g |

Water was added to make a total quantity of 700 ml, and glacial acetic acid and aqueous ammonia were added to obtain a pH of 6.5. The stabilizer and stabilizer replenisher used had the following composition:

| | |
|---|---|
| 1,2-benzisothiazolin-3-one | 0.1 g |
| 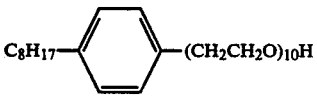 (50% aqueous solution) | 2.0 ml |
| Hexamethylenetetramine | 0.2 g |
| Hexahydro-1,3,5-tris(2-hydroxyethyl)-s-triazine | 0.3 g |

Water was added to make a total quantity of 1000 ml, and potassium hydroxide and 50% sulfuric acid were added to obtain a pH of 7.0.

EXAMPLE 2

Preparation of Octahedral Silver Iodobromide Emulsion EM-20 (Comparative Emulsion)

An octahedral silver iodobromide emulsion was prepared using monodispersed silver iodobromide grains having an average grain size of 0.4 μm and a silver iodide content of 2 mol % as seed crystals.

While vigorously stirring solution G-20 at a temperature of 70° C., a pAg of 7.8 and a pH of 7.0, the seed emulsion in an amount equivalent to 0.64 mol was added.

Formation of Inner Phase

Then, H-20, S-20 and MC-20 in a total amount equivalent to 1.36 mol were added to the reactor at increasing flow rates by the triple jet method over a period of 71 minutes, while keeping a molar ratio of 70:70:30.

During grain formation, pAg and pH were regulated by adding an aqueous solution of potassium bromide and an aqueous solution of acetic acid to the reactor.

Formation of Outer Phase

Subsequently, while maintaining a pAg of 10.1 and a pH of 6.0, H-20, S-20 and MC-20 in a total amount equivalent to 8 mol were added to the reactor at increasing flow rates by the triple jet method over a period of 44 minutes, while keeping a molar ratio of 94:94:6.

During grain formation, pAg and pH were regulated using an aqueous solution of potassium bromide and an aqueous solution of acetic acid.

After grain formation, the mixture was washed by the conventional flocculation method and then re-dispersed in gelatin and adjusted to a pH of 5.8 and a pAg of 8.06 at 40° C.

The resulting emulsion was a monodispersed emulsion comprising octahedral silver iodobromide grains having an average grain size of 1.0 μm and a distribution width of 10 7%. This emulsion is referred to as EM-20.

Preparation of Octahedral Silver Iodobromide Emulsion EM-21 (Inventive Emulsion)

EM-21 was prepared in roughly the same manner as in emulsion EM-20 except that the outer phase was prepared as follows.

Formation of Outer Phase

After an aqueous solution of ammonium acetate in an amount equivalent to 8.0 mol was added, MC-21 in an amount equivalent to 8.0 mol was added to the reactor by a single jet method at increasing flow rates over a period of 53 minutes, while maintaining a pAg of 10.1 and a pH of 6.0.

During grain formation, pAg was regulated using an aqueous solution of potassium bromide and an aqueous solution of silver nitrate, pH regulated using an aqueous solution of acetic acid and an aqueous solution of ammonia.

Then, the mixture was washed and adjusted to the desired pH and pAg levels in the same manner as in emulsion EM-20.

The resulting emulsion was a monodispersed emulsion comprising octahedral silver iodobromide grains having an average grain size of 1.0 μm and a distribution width of 10.5%. This emulsion is referred to as EM-21.

Comparative emulsions EM-22, 24 and 26 with different silver iodide contents in the outer phase were prepared in the same manner as in emulsion EM-20. Inventive emulsions EM-23, 25 and 27 with different silver iodide contents in the outer phase were prepared in the same manner as in emulsion EM-21, using MC-23, MC-25 and MC-27. Addition time was optimally controlled for each emulsion.

The emulsions are summarized in Table 3.

TABLE 3

| | Inner phase | | Outer phase | |
|---|---|---|---|---|
| Emulsion | Silver iodide content | Method of formation | Silver iodide content | Method of formation |
| EM-20 (comparative emulsion) | 30 mol % | Method a | 2 mol % | Method a |
| EM-21 (inventive emulsion) | 30 mol % | Method a | 2 mol % | Method b |
| EM-22 (comparative emulsion) | 30 mol % | Method a | 4 mol % | Method a |
| EM-23 (inventive emulsion) | 30 mol % | Method a | 4 mol % | Method b |
| EM-24 (comparative emulsion) | 30 mol % | Method a | 8 mol % | Method a |
| EM-25 (inventive emulsion) | 30 mol % | Method a | 8 mol % | Method b |
| EM-26 (comparative emulsion) | 30 mol % | Method a | 12 mol % | Method a |
| EM-27 (inventive emulsion) | 30 mol % | Method a | 12 mol % | Method b |

| G-20 | |
|---|---|
| Ossein gelatin (average molecular weight = 100000) | 80.0 g |
| Compound I | 30.0 ml |
| 28% aqueous ammonia | 440.0 ml |
| 56% aqueous solution of acetic acid | 660.0 ml |

Water was added to make a total quantity of 4000.0 ml.

H-20

An aqueous solution of potassium bromide.

S-20

An aqueous solution of ammoniacal silver nitrate.

MC-20

A fine grain emulsion comprising 3 wt % gelatin and silver iodide grains having an average grain size of 0.03 μm.

MC-21

A fine grain emulsion comprising 3 wt % gelatin and silver iodobromide grains having a silver iodide content of 2 mol % and an average grain size of 0.02 μm.

MC-23

A fine grain emulsion comprising 3 wt % gelatin and silver iodobromide grains having a silver iodide content of 4 mol % and an average grain size of 0.02 μm.

MC-25

A fine grain emulsion comprising 3 wt % gelatin and silver iodobromide grains having a silver iodide content of 8 mol % and an average grain size of 0.02 μm.

MC-27

A fine grain emulsion comprising 3 wt % gelatin and silver iodobromide grains having a silver iodide content of 12 mol % and an average grain size of 0.02 μm.

Preparation of Silver Halide Photographic Light-sensitive Material Samples

To emulsions EM-20 through EM-27 were added an aqueous solution of ammonium thiocyanate, an aqueous solution of chloroauric acid tetrahydrate and an aqueous solution of sodium thiosulfate dihydrate, and each emulsion was subjected to a conventional chemical sensitization process at 55° C. optimally.

After completion of ripening, a methanol solution of the following two sensitizing dyes 1 and 2 described below was added to these emulsions so that the amount of dyes became 200 mg per mol of silver halide, followed by stirring at 46° C. for 10 minutes. Then, 4-hydroxy-6-methyl-1,3,3a,7-tetrazaindene and 1-phenyl-5-mercaptotetrazole were added, and the following coupler dispersions along with an ordinary extender and hardener were added. This mixture was coated and dried on a triacetate base to an amount of silver coated of 15 mg/dm$^2$ to yield sample Nos. 20 through 27.

Sensitizing dye 1: Pyridinium salt of anhydro-3,5'-dichloro-3,3'-di(3-sulfopropyl)-9-ethylthiacarbocyaninehydroxide Sensitizing dye 2: Triethylamine salt of anhydro-9-ethyl-3,3'-di(3-sulfopropyl)-4,5,4',5'-dibenzothiacarbocyaninehydroxide

| Coupler dispersions (equivalent to 1 mol of silver halide) | |
|---|---|
| C-1 | |
| The following coupler 1 | 28.3 g |
| Tricresyl phosphate | 67.1 g |
| Ethyl acetate | 268 ml |
| C-2 | |
| Gelatin | 67.1 g |
| 5% aqueous solution of Alkanol X | 215 ml |

-continued

| Coupler dispersions (equivalent to 1 mol of silver halide) |
|---|
| (produced by Du-Pont) |

Water was added to make a total quantity of 1342 ml.

The above dispersions C-1 and C-2 were mixed and ultrasonically dispersed before use.

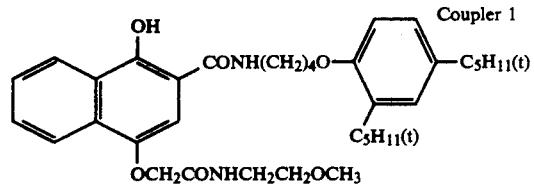

The samples thus prepared were each subjected to exposure through an optical wedge and a Toshiba glass filter Y-48 using a light source with a color temperature of 5400° K. and then processed as follows.

| | | |
|---|---|---|
| 1. Color development | 1 minute 45 seconds | 38.0 ± 0.1° C. |
| 2. Bleaching | 6 minutes 30 seconds | 38.0 ± 3.0° C. |
| 3. Washing | 3 minutes 15 seconds | 24 to 41° C. |
| 4. Fixing | 6 minutes 30 seconds | 38.0 ± 3.0° C. |
| 5. Washing | 3 minutes 15 seconds | 24 to 41° C. |
| 6. Stabilization | 3 minutes 15 seconds | 38.0 ± 3.0° C. |
| 7. Drying | Under 50° C. | |

The processing solutions used in the respective processes were the same as in Example 1.

Each obtained sample was subjected to determination of relative fogging, relative sensitivity and relative RMS value immediately after preparation thereof. The results are shown in Table 4.

TABLE 4

| Sample No. | Emulsion used | Relative RMS value | Relative sensitivity | Relative fogging |
|---|---|---|---|---|
| Sample No. 20 (comparative) | EM-20 (comparative) | 100 | 100 | 100 |
| Sample No. 21 (inventive) | EM-21 (inventive) | 65 | 160 | 70 |
| Sample No. 22 (comparative) | EM-22 (comparative) | 100 | 100 | 100 |
| Sample No. 23 (inventive) | EM-23 (inventive) | 75 | 145 | 70 |
| Sample No. 24 (comparative) | EM-24 (comparative) | 100 | 100 | 100 |
| Sample No. 25 (inventive) | EM-25 (inventive) | 90 | 135 | 85 |
| Sample No. 26 (comparative) | EM-26 (comparative) | 100 | 100 | 100 |
| Sample No. 27 (inventive) | EM-27 (inventive) | 100 | 120 | 95 |

*Figures for sample Nos. 21, 23, 25 and 27 are relatively expressed assuming as 100 the figures obtained from sample Nos. 20, 22, 24 and 26, respectively.

EXAMPLE 3

Preparation of Octahedral Silver Iodobromide Emulsion EM-30 (Inventive Emulsion)

An octahedral silver iodobromide emulsion was prepared using monodispersed silver iodobromide grains having an average grain size of 0.4 μm and a silver iodide content of 2 mol % as seed crystals.

While vigorously stirring solution G-30 at a temperature of 75° C., a pAg of 7.8 and a pH of 7.0, the seed emulsion in an amount equivalent to 0.64 mol was added.

Formation of Inner Phase

H-30, S-30 and MC-30 in a total amount equivalent to 2 mol were added to the reactor by the triple jet method at increased flow rates over a period of 95 minutes, while keeping a molar ratio of 65:65:35.

Formation of Outer Phase

Subsequently, after adding an aqueous solution of ammonium acetate in an amount equivalent to 7.36 mol, MC-31 in an amount equivalent to 7.36 mol was added to the reactor by the single jet method at increased flow rates over a period of 41 minutes, while keeping a pAg of 10.1 and a pH of 6.0.

The resulting emulsion was a monodispersed emulsion comprising octahedral silver iodobromide grains having an average grain size of 1.0 μm and a distribution width of 9.8%. This emulsion is referred to as EM-30.

Preparation of Octahedral Silver Iodobromide Emulsion EM-31 (Comparative Emulsion)

Emulsion EM-31 was prepared in roughly the same manner as in emulsion EM-30 except that the inner phase was prepared as follows.

Formation of Inner Phase

After adding an aqueous solution of ammonium acetate in an amount equivalent to 2 mol, MC-32 in an amount equivalent to 2 mol was added to the reactor by the single jet method at increased flow rates over a period of 140 minutes.

The resulting emulsion was a monodispersed emulsion comprising octahedral silver iodobromide grains having an average grain size of 1.0 μm and a distribution width of 11.2%. This emulsion is referred to as EM-31.

Inventive emulsions EM-32, 34 and 36 with different silver iodide contents in the inner phase were prepared in the same manner as in emulsion EM-30. Comparative emulsions EM-33, 35 and 37 with different silver iodide contents in the outer phase were prepared in the same manner as in emulsion EM-31, using MC-33, MC-34 and MC-35. Addition time was optimally controlled for each emulsion.

The emulsions are summarized in Table 5.

TABLE 5

| Emulsion | Inner phase | | Outer phase | |
|---|---|---|---|---|
| | Silver iodide content | Method of formation | Silver iodide content | Method of formation |
| EM-30 (inventive emulsion) | 35 mol % | Method a | 0 mol % | Method b |
| EM-31 (comparative emulsion) | 35 mol % | Method b | 0 mol % | Method b |
| EM-32 (inventive emulsion) | 20 mol % | Method a | 0 mol % | Method b |
| EM-33 (comparative emulsion) | 20 mol % | Method b | 0 mol % | Method b |
| EM-34 (inventive emulsion) | 15 mol % | Method a | 0 mol % | Method b |
| EM-35 (comparative emulsion) | 15 mol % | Method b | 0 mol % | Method b |
| EM-36 (inventive emulsion) | 10 mol % | Method a | 0 mol % | Method b |
| EM-37 (comparative emulsion) | 10 mol % | Method b | 0 mol % | Method b |

| G-30 | |
|---|---|
| Ossein gelatin (average molecular weight = 100000) | 80.0 g |
| Compound I | 30.0 ml |
| 28% aqueous ammonia | 440.0 ml |
| 56% aqueous solution of acetic acid | 660.0 ml |

Water was added to make a total quantity of 4000.0 ml.

H-30

An aqueous solution of potassium bromide.

S-30

An aqueous solution of ammoniacal silver nitrate.

MC-30

A fine grain emulsion comprising 3 wt % gelatin and silver iodide grains having an average grain size of 0.03 μm.

MC-31

A fine grain emulsion comprising 3 wt % gelatin and silver bromide grains having an average grain size of 0.02 μm.

MC-32

A fine grain emulsion comprising 3 wt % gelatin and silver iodobromide grains having a silver iodide content of 35 mol % and an average grain size of 0.02 μm.

MC-33

A fine grain emulsion comprising 3 wt % gelatin and silver iodobromide grains having a silver iodide content of 20 mol % and an average grain size of 0.02 μm.

MC-34

A fine grain emulsion comprising 3 wt % gelatin and silver iodobromide grains having a silver iodide content of 15 mol % and an average grain size of 0.02 μm.

MC-35

A fine grain emulsion comprising 3 wt % gelatin and silver iodobromide grains having a silver iodide content of 10 mol % and an average grain size of 0.02 μm.

Preparation of Silver Halide Photographic Light-sensitive Material Samples

Emulsions EM-30 through EM-37 were each subjected to chemical sensitization and spectral sensitization optimally, after which they were treated in the same manner as in Example 2 to yield sample Nos. 30 through 37, which were evaluated as to photographic performance. The results are shown in Table 6.

TABLE 6

| Sample No. | Emulsion used | Relative RMS value | Relative sensitivity | Relative fogging |
|---|---|---|---|---|
| Sample No. 30 (inventive) | EM-20 (inventive) | 65 | 140 | 90 |
| Sample No. 31 (comparative) | EM-31 (comparative) | 100 | 100 | 100 |
| Sample No. 32 (inventive) | EM-32 (inventive) | 80 | 135 | 95 |
| Sample No. 33 (comparative) | EM-33 (comparative) | 100 | 100 | 100 |
| Sample No. 34 (inventive) | EM-34 (inventive) | 90 | 135 | 90 |
| Sample No. 35 (comparative) | EM-35 (comparative) | 100 | 100 | 100 |
| Sample No. 36 (inventive) | EM-36 (inventive) | 95 | 120 | 95 |
| Sample No. 37 (comparative) | EM-37 (comparative) | 100 | 100 | 100 |

*Figures for sample Nos. 30, 32, 34 and 36 are relatively expressed assuming as 100 the figures obtained from sample Nos. 31, 33, 35 and 37, respectively.

When the present invention and the prior art are compared on the basis of Examples 1 through 3, it is evident that the production method of the present invention offers great improvement in the grain growth speed, and that the silver halide light-sensitive material of the present invention surpasses that obtained by the prior art in graininess, sensitivity and fogging.

The effect of the present invention is enhanced when the grain structure comprises phase A in the inner portion and phase B outside thereof. For silver iodobromide grains, the effect is particularly enhanced when a phase having a silver iodide content of not less than 10 mol %, more preferably not less than 15 mol %, is formed by method a and a phase having a silver iodide content of not more than 10 mol % by method b.

What is claimed is:

1. A method of producing a silver halide emulsion comprising light-sensitive silver halide grains containing at least one first silver halide phase and at least one second halide phase, comprising the steps of;

(a) forming said at least one first silver halide phase in the presence of substantially one kind of first fine silver halide grains, said at least one first silver halide phase having a silver halide composition different from that of said substantially one kind of first fine silver halide grains, and (b) forming at least one second silver halide phase by supplying at least one kind of second fine silver halide grains having a solubility product higher than that of said substantially one kind of first fine silver halide grains.

2. The method of claim 1, wherein said substantially one kind of first fine silver halide grains is substantially fine silver iodide grains, and said at least one second silver halide phase is formed exclusively by supplying said at least one kind of second fine silver halide grains.

3. The method of claim 2, wherein the silver iodide content of a silver halide phase having the highest silver iodide content among said first silver halide phases is higher than that of said second silver halide phases.

4. The method of claim 3, wherein said silver halide grains contain at least one first silver halide phase having the silver iodide content of not less than 15 mol %.

5. The method of claim 4, wherein said silver halide grains contain at least one second silver halide phase having the silver iodide content of not more than 10 mol %.

* * * * *